US007097265B2

(12) United States Patent
Koyama

(10) Patent No.: US 7,097,265 B2
(45) Date of Patent: Aug. 29, 2006

(54) DRIVING DEVICE OF INK-JET PRINT HEAD, CONTROL METHOD OF THE DRIVING DEVICE, AND LIQUID DROP DISCHARGE APPARATUS

(75) Inventor: Minoru Koyama, Matsumoto (JP)

(73) Assignee: Seiko Epson Corporation, (JP)

( * ) Notice: Subject to any disclaimer, the term of this patent is extended or adjusted under 35 U.S.C. 154(b) by 244 days.

(21) Appl. No.: 10/789,935

(22) Filed: Feb. 27, 2004

(65) Prior Publication Data

US 2004/0223016 A1 Nov. 11, 2004

(30) Foreign Application Priority Data

Feb. 28, 2003 (JP) ..... 2003-054011

(51) Int. Cl.
*B41J 29/38* (2006.01)
*B41J 2/05* (2006.01)

(52) U.S. Cl. ..... 347/10; 347/5; 347/9; 347/11; 347/57

(58) Field of Classification Search ..... 347/9, 347/10

See application file for complete search history.

(56) References Cited

U.S. PATENT DOCUMENTS

2002/0113832 A1* 8/2002 Kanematsu et al. ..... 347/14

FOREIGN PATENT DOCUMENTS

| | | |
|---|---|---|
| JP | 05-116282 | 5/1993 |
| JP | 09-039272 | 2/1997 |
| JP | 2002-264366 | 9/2002 |

* cited by examiner

*Primary Examiner*—Lamson Nguyen
*Assistant Examiner*—Jannelle M. Lebron
(74) *Attorney, Agent, or Firm*—Harness, Dickey & Pierce, P.L.C.

(57) ABSTRACT

A driving device of an ink-jet print head is provided that discharges liquid drops through a plurality of nozzles. The driving device comprises a data storage unit which stores a data block for liquid drop discharge; a data determination unit which determines the stored data block; a shift register which outputs the determined data block to the ink-jet print head; and a clock signal generation unit which generates clock signals for driving the shift register. The data determination unit determines whether the data block has a predetermined array. When the data block has the predetermined array, the clock signal generation unit stops generating the clock signals and the shift register outputs the data block having the predetermined array to the ink-jet print head.

4 Claims, 9 Drawing Sheets

PRIOR ART

PRIOR ART

DRIVING DEVICE OF INK-JET PRINT HEAD, CONTROL METHOD OF THE DRIVING DEVICE, AND LIQUID DROP DISCHARGE APPARATUS

RELATED APPLICATIONS

This application claims priority to Japanese Patent Application No. 2003-054011 filed Feb. 28, 2003 which is hereby expressly incorporated by reference herein in its entirety.

BACKGROUND OF THE INVENTION

1. Technical Field of the Invention

The present invention relates to a driving device of an ink-jet print head, a control method of the driving device, and a liquid drop discharge apparatus.

2. Description of the Related Art

The overview of a head unit and a driving device thereof for an ink-jet liquid drop discharge apparatus will be described with reference to FIG. 9.

FIG. 9 is a view for explaining the relationship between an information processor main body 910 (hereinafter, referred to as a driving device) that is a control subject, and a head unit 950 to be controlled. In FIG. 9, the driving device 910 includes a driving signal generator 915 which generates a driving signal $V_{out}$ to discharge liquid drops through a plurality of nozzles, and a data storage unit, which converts driving data input from a high-rank unit (not shown) into data having a structure suitable for transmission to the head unit 950 and outputs the converted driving data in series, that is, a latch circuit 911, and a shift register 913. A print timing signal PTS for driving is input from the high-rank unit, and the latch circuit 911 receives input driving data at a rising edge of the print timing signal PTS and stores the input driving data.

A latch signal LAT, which is obtained by delaying the print timing signal PTS for a predetermined amount of time, is supplied to the driving signal generator 915 from the high-rank unit. In addition, a static voltage $V_H$ of about 30 V is applied to the driving signal generator 915 and becomes a power source for a driving signal. The driving signal data input from a data bus is digital-to-analog (D/A) converted by the driving signal generator 915 and is output as the driving signal $V_{out}$.

Meanwhile, as shown in FIG. 9, the head unit 950 includes a shift register 951 for inputting data DATA which is driving information for each nozzle, a latch circuit 952 for storing the data DATA of the shift register 951, a selector 953 which selects driving/non-driving, and a nozzle driving unit 954 which has an actuator for driving a nozzle (not shown) communicating with each of a plurality of liquid drop containers. The shift register 951 converts the data DATA, which is input serial data, into parallel data. The latch circuit 952 is a data storage unit that stores the parallel data output from the shift register 951 in each nozzle. In addition, the selector 953 is configured such that the driving signal $V_{out}$ is transmitted to the selector 953 from the driving device 910, driving information distributed for each nozzle is applied to a desired nozzle only during driving and is not applied to the desired nozzle during non-driving. In the nozzle driving unit 954, each actuator to which the driving signal $V_{out}$ is applied is driven and liquid drops are discharged through a plurality of nozzles. A logic power source $V_{cc}$ and a ground line GND are power source lines. A voltage of +5 V or +3.3 V is supplied to the logic power source $V_{cc}$.

An object substrate on which liquid drops are discharged using the aforementioned ink-jet liquid drop discharge apparatus has become larger. With the large-sized substrate object, the number of head units or nozzles tends to increase. For this reason, there are drawbacks such as an increase in power consumption of a driving device. In particular, liquid drop discharge apparatuses for industrial uses generally include at least ten head units for improving processing efficiency. In this case, however, the amount of radiated heat also increases with the increase in power consumption. Such increases in power consumption and the amount of radiated heat become a serious problem when liquid drops are uniformly and consecutively discharged onto the object substrate (so-called, application of liquid drops to the entire surface of a region).

The present invention has been made to address the above problem with the prior art. It is therefore an object of the present invention to provide a driving device of an ink-jet print head, a control method of the driving device, and a liquid drop discharge apparatus, which have low current consumption and a small amount of radiated heat.

SUMMARY

To address the problem and attain the object described above, according to the present invention, there is provided a driving device of an ink-jet print head that discharges liquid drops through a plurality of nozzles. The driving device comprises a data storage unit, which stores a data block for liquid drop discharge; a data determination unit, which determines the stored data block; a shift register, which outputs the determined data block to the ink-jet print head; and a clock signal generation unit, which generates clock signals for driving the shift register. The data determination unit determines whether the data block has a predetermined array. When the data block has the predetermined array, the clock signal generation unit stops generating the clock signals. The shift register outputs the data block having the predetermined array to the ink-jet print head. Thus, when the data block output to the print head has the predetermined array, the clock signal generation unit stops generating the clock signals. Also, the shift register does not operate based on the clock signals. At this time, the shift register outputs the data block having the predetermined array, which is prefixed (i.e., pre-selected) data, to the print head. As a result, it is possible to reduce the power consumption and the amount of radiated heat that are caused by the driving of the shift register.

According to a preferred aspect of the present invention, the data determination unit determines whether all the data items of the data block are discharge data items for which liquid drops are to be discharged or non-discharge data items for which liquid drops are not to be discharged, the clock signal generation unit stops generating the clock signals when all the data items of the data block are the discharge data items or the non-discharge data items, and the shift register outputs the discharge data items or the non-discharge data items to the ink-jet print head when the generation of the clock signals is stopped. Thus, when all the data items of the data block are the discharge data items or the non-discharge data items, the clock signal generation unit stops generating the clock signals. Also, the shift register does not operate based on the clock signals. At this time, the shift register outputs the discharge or non-discharge data block having the prefixed array, which is predetermined data, to the print head. As a result, it is possible to reduce the power consumption and the amount of radiated heat that are caused by the driving of the shift register.

According to a preferred embodiment of the present invention, the plurality of nozzles are provided in every block having a predetermined number of the nozzles, and a plurality of data determination units are provided in the corresponding blocks. Thus, even when the number of nozzles is large, the driving of the shift register can be controlled for each block. As a result, it is possible to reliably reduce the power consumption and the amount of radiated heat that are caused by the driving of the shift register.

According to the present invention, there can be provided a control method of a driving device of an ink-jet print head that discharges liquid drops through a plurality of nozzles. The control method comprises a data storage step of storing a data block for liquid drop discharge; a data determination step of determining the stored data block; a data output step of outputting the determined data block to the ink-jet print head via a shift resistor; and a clock signal generation step of generating clock signals for driving the shift register. The data determination step comprises determining whether the data block has a predetermined array, and the clock signal generation step comprises stopping the generation of the clock signals when the data block has the predetermined array. Thus, when the data block output to the print head has the predetermined array, the clock signal generation unit stops generating the clock signals. The shift register does not operate based on the clock signals. At this time, the shift register outputs the data block having the predetermined array, which is prefixed data, to the print head. As a result, it is possible to reduce the power consumption and the amount of radiated heat that are caused by the driving of the shift register.

According to a preferred embodiment of the present invention, the data determination step comprises determining whether all the data items of the data block are discharge data items for which liquid drops are to be discharged or non-discharge data items for which liquid drops are not to be discharged, the clock signal generation step comprises stopping the generation of the clock signals when all the data items of the data block are the discharge data items or the non-discharge data items, and the data block output step preferably comprises outputting the discharge data items or the non-discharge data items to the ink-jet print head when the generation of the clock signals is stopped. Thus, when all the data items of the data block are the discharge data items or non-discharge data items, the clock signal generation step stops generating the clock signals. Also, the shift register does not operate based on the clock signals. At this time, the shift register outputs the discharge or non-discharge data block having the predetermined array, which is prefixed data, to the print head. As a result, it is possible to reduce the power consumption and the amount of radiated heat that are caused by the driving of the shift register.

According to the present invention, there can be provided a liquid drop discharge apparatus comprising: a driving device of an ink-jet print head as described above, and a print head having a control unit that drives the plurality of nozzles based on the data block output from the driving device. This makes it possible to reduce the power consumption and the amount of radiated heat that are caused by the driving of the shift register. As a result, it is possible to achieve a liquid drop discharge apparatus that reduces the power consumption thereof and the amount of radiated heat while using a conventional print head.

DETAILED DESCRIPTION

Figure 1:
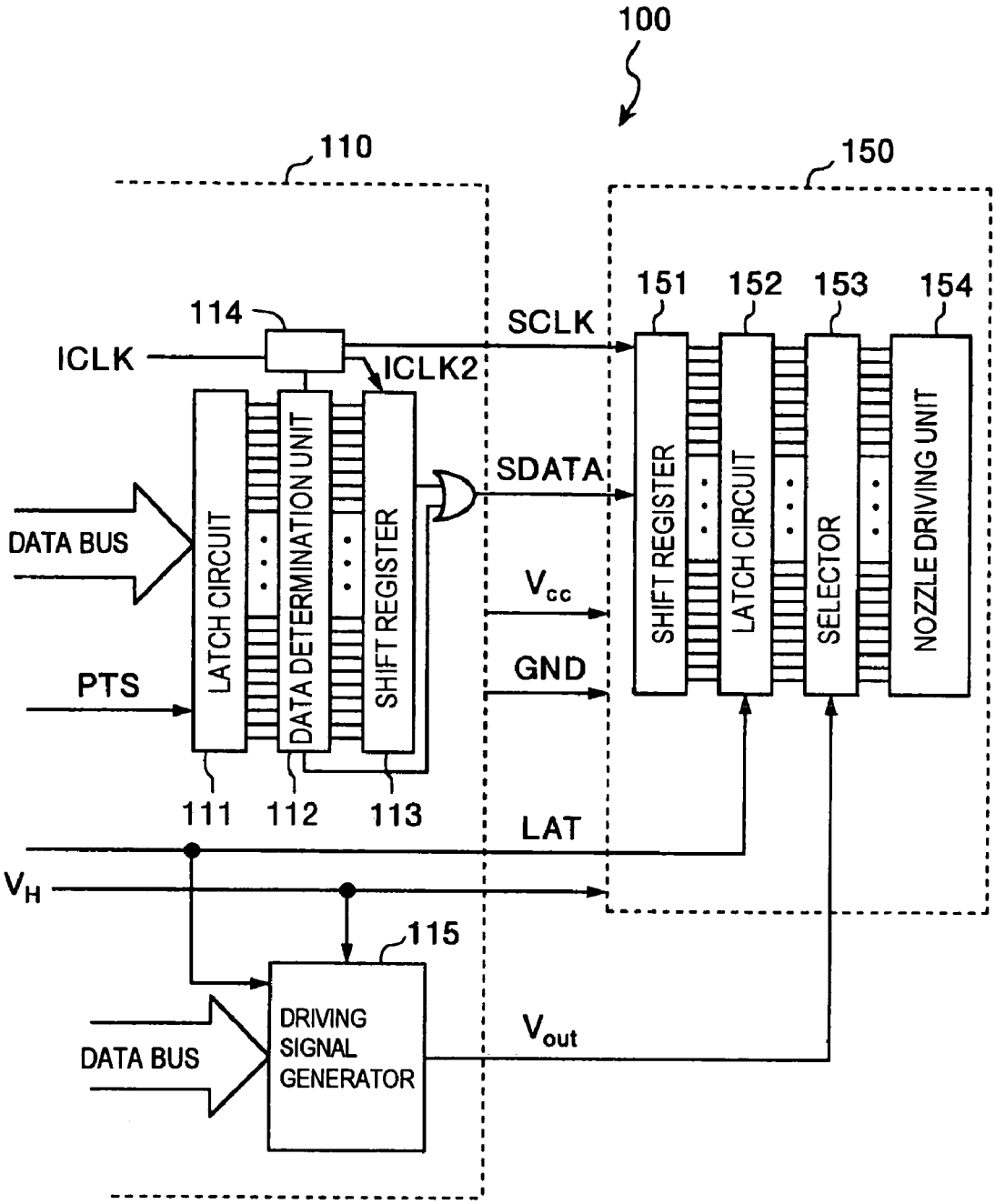
FIG. 1 schematically shows the structure of a driving device and a head unit according to a first embodiment of the present invention.

Hereinafter, preferred embodiments of the present invention will be described with reference to the accompanying drawings. First, the overview of a driving device of an ink-jet print head according to a first embodiment of the present invention will be described with reference to FIG. 1. FIG. 1 is a view for explaining the relationship between a driving device 110 for an ink-jet head module, which is an information processor main body (hereinafter, referred to as a driving device) as a control subject, and a head unit 150 as an object to be controlled. In FIG. 1, the driving device 110 includes a driving signal generator 115 which generates a driving signal $V_{out}$ to discharge liquid drops through a plurality of nozzles, and a data storage unit, which converts driving data input from a high-rank unit (not shown) into data having a structure suitable for transmission to the head unit 150 and outputs the converted driving data in series, that is, a latch circuit 111, and a shift register 113. A print timing signal PTS for driving is input to the latch circuit 111 from the high-rank unit, and the latch circuit 111 receives input driving data at a rising edge of the print timing signal PTS and stores the input driving data.

A latch signal LAT, which is obtained by delaying the print timing signal PTS for a predetermined amount of time, is supplied to the driving signal generator 115 from the high-rank unit. In addition, a static voltage $V_H$ of about 30 V is applied to the driving signal generator 115 and becomes a power source for a driving signal. The driving signal data input from a data bus is digital-to-analog (D/A) converted by the driving signal generator 115 and is output as the driving signal $V_{out}$.

A data determination unit 112 determines the contents of a stored data block. The operation of the data determination unit 112 will be described in detail later. A clock signal generation unit 114 generates an internal shift clock signal ILCK2 for driving the shift register 113 in the driving device 110. The shift register 113 converts a parallel data block into a serial data block SDATA and outputs the serial data block SDATA to the head unit 150.

Next, the schematic configuration of the head unit 150 will be explained. The head unit 150 is provided with a shift register 151 to which the serial data block SDATA is input.

The head unit 150 also includes a nozzle driving unit 154 that has actuators for driving nozzles (not shown) communicating with a plurality of liquid drop containers and a selector 153 that selects a nozzle to be driven. A data storage unit, i.e., a latch circuit 152 for storing the serial data block SDATA transmitted from the driving device 110 is provided at the preceding stage of the selector 153. The driving signal $V_{out}$ transmitted from the driving device 110 is applied to the selector 153. Driving information for each nozzle is selectively applied to the selector 153. In nozzle driving unit 154, actuators to which the driving signal $V_{out}$ is supplied are driven, thereby discharging liquid drops from desired nozzles.

Assuming that an external shift clock signal SCLK in sixty four nozzle heads has a frequency of 1 MHz, the latch signal LAT input to the latch circuit 152 is activated in synchronization with the driving signal $V_{out}$ during a period of more than 64 μs. During this latch period, a serial data block SDATA for the next latch period is latched in the latch circuit 152 through the shift register 151 and is input to the selector 153.

According to the operating timing in the above configuration, when the latch signal LAT is activated, the driving signal $V_{out}$ and a serial data block SDATA before one latch period are input to the head unit 150 from the driving device 110. In the head unit 150, a corresponding nozzle is driven based on transmitted various signals or a serial data block SDATA and liquid drops are discharged to a predetermined region of a media to be printed.

Figure 2A:
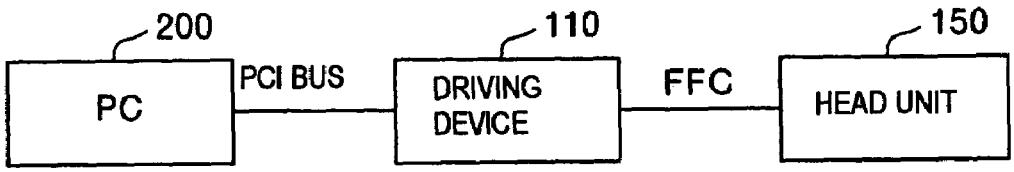
FIGS. 2A and 2B are block diagrams of the driving device according to the first embodiment of the present invention.
Figure 2B:
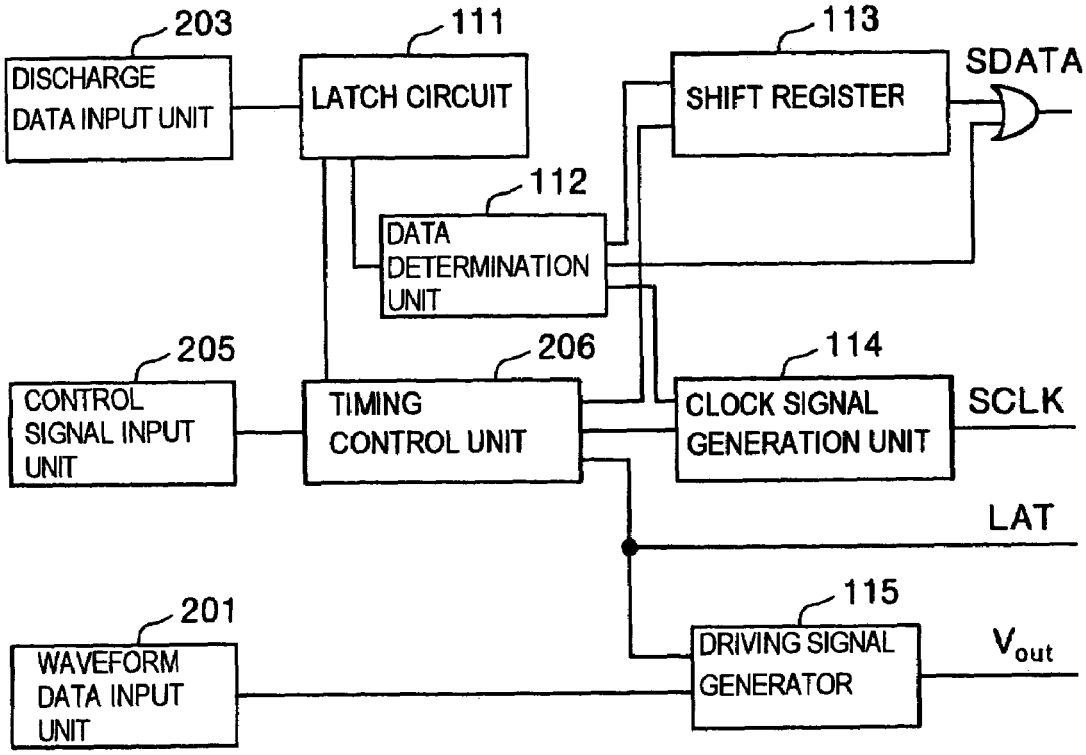

FIG. 2(*a*) is a block diagram schematically showing the liquid drop discharge apparatus 100 (FIG. 1) according to the present embodiment. As shown in FIG. 2(*a*), a control signal from a computer 200 is transmitted to the driving device 110 via a PCI bus for exclusive use. The driving device 110 and the head unit 150 are connected through the flexible flat cable (hereinafter, referred to as FFC). FIG. 2(*b*) is a block diagram schematically showing the driving device 110. Data corresponding to the amount of liquid drops discharged through the head is input into a waveform data input unit 201. The driving signal generator 115 generates a signal having a waveform shape corresponding to the amount of liquid drops based on the input data and outputs the generated signal as a signal $V_{out}$. In addition, data input into a discharge data input unit 203 is first stored in a latch circuit (data storage unit) 111. The data determination unit 112 determines whether the stored data is a predetermined data block.

A print timing signal PTS corresponding to the discharge timing of liquid drops is input to a control signal input unit 205. In addition, the print timing signal PTS is input to the latch circuit 111 and a clock signal generation unit 114 via a timing control unit 206. The timing control unit 206 generates a latch signal LAT based on the input print timing signal PTS. The latch signal LAT is output to the driving signal generation unit 115 and the head unit 150 through the flexible flat cable FFC. The clock signal generation unit 114 generates the internal shift clock signal ILCK2 that is a shift clock of the shift register 113 and the external shift clock signal SCLK that is output to the head unit 150 through the flexible flat cable FFC.

Figure 3:
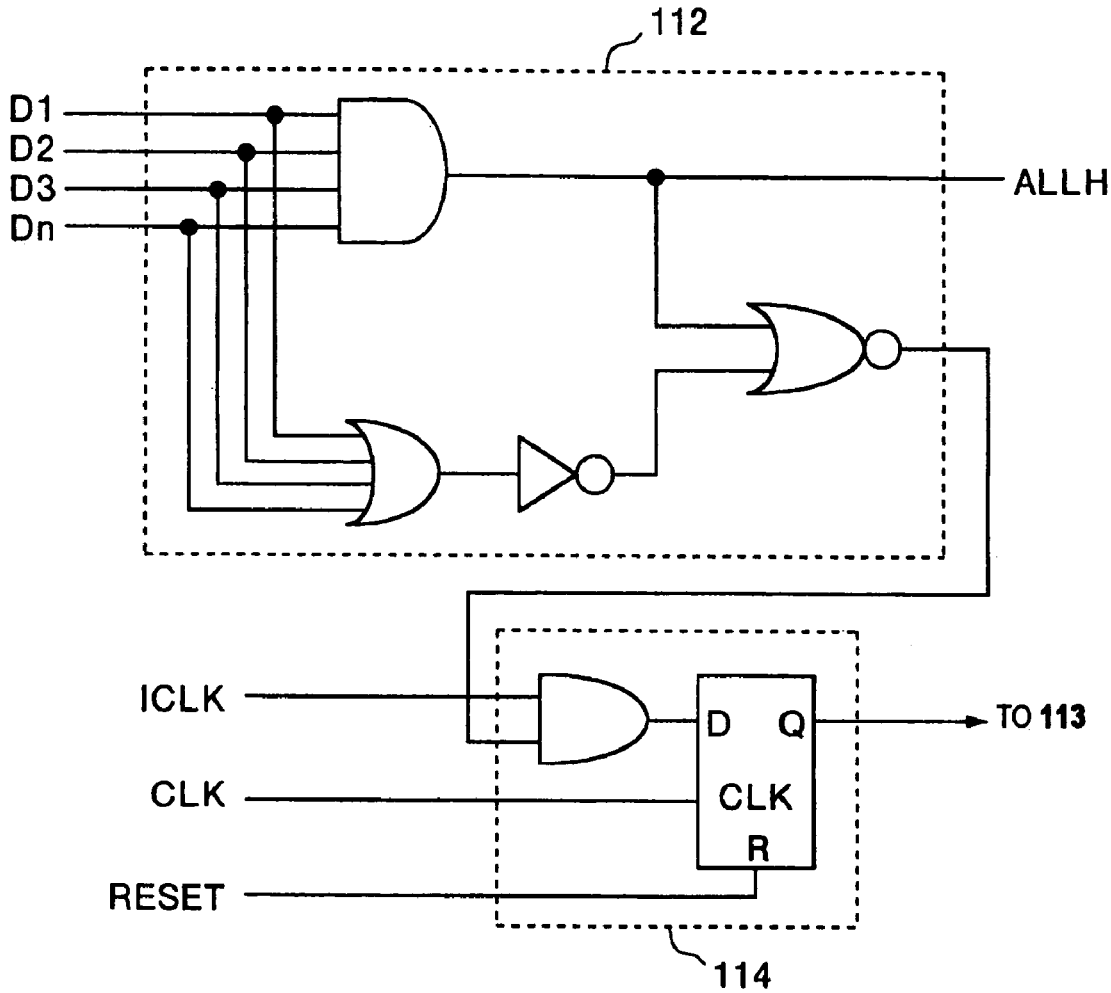
FIG. 3 is a logic circuit diagram of the driving device according to the first embodiment of the present invention.

In FIG. 3, the circuitry of the data determination unit 112 and the clock signal generation unit 114 is represented by logic symbols. The data determination unit 112 generates an output signal '0' when all data items D1, D2, D3, . . . , and Dn of a data block are discharge data (e.g., '1') or are non-discharge data (e.g., '0'). The clock signal generation unit 114 does not generate a serial signal, i.e., the internal shift clock signal ILCK2 for the shift register 113 when '0' is output from the data determination unit 112. Thus, when all the data items D1, D2, D3, . . . , and Dn of the data block are '1' or '0', the shift register 113 does not operate. At this time, the shift register 113 outputs pre-fixed data, i.e., the discharge data (all of D1 to Dn are 1) or the non-discharge data (all of D1 to Dn are 0) to the head unit 150. More specifically, a signal ALLH output from the data determination unit 112 is 1 only when all the data items of the latch circuit 111 are 1. Data output from the shift register 113 goes to 1 by an OR gate when the signal ALLH is 1. When the signal ALLH is 0, the data output from the shift register 113 is the same as the previous final data and thus goes to 0.

Figure 4:
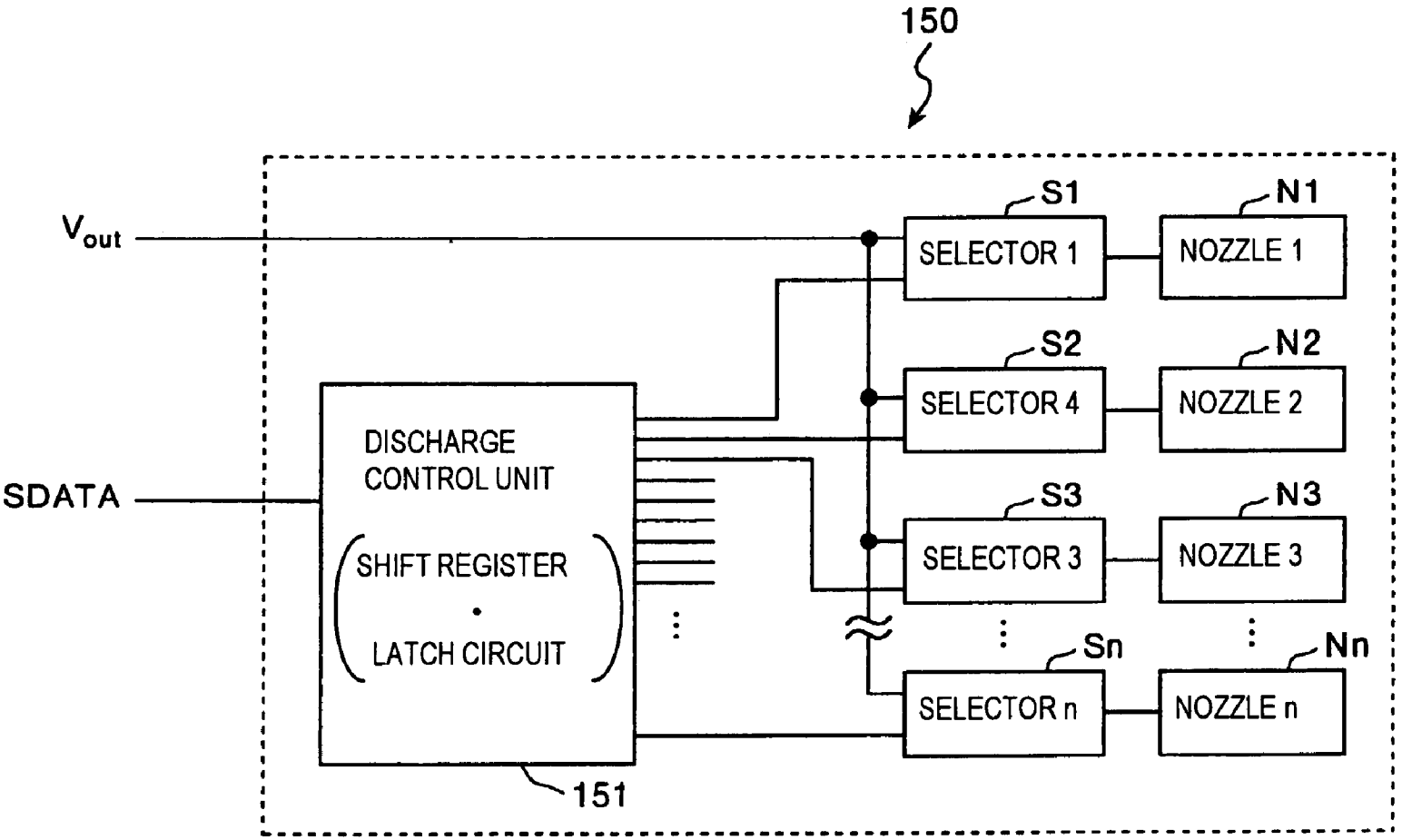
FIG. 4 is a block diagram of the head unit according to the first embodiment of the present invention.

FIG. 4 is a schematic block diagram of the head unit 150. The head unit 150 may have the same configuration as that of a conventional head unit. The head unit 150 includes a shift register 151, a latch circuit 152, a selector 153, and a nozzle driving unit 154.

The serial data block SDATA that is serially input from the driving device 110 is converted into a parallel data block by the shift register 151 and the parallel data block is stored in the latch circuit 152. The stored data block is selectively input to n selectors S1 to Sn, each of which is composed of an analog switch. The driving signal $V_{out}$ output from the driving device 110 is input to the selectors S1 to Sn and is output to nozzles N1 to Nn only when selectively input data indicates a discharge state. In the nozzle driving unit 154, actuators to which the driving signal $V_{out}$ is supplied are driven, and thus liquid drops are discharged from the corresponding nozzles.

Figure 5:
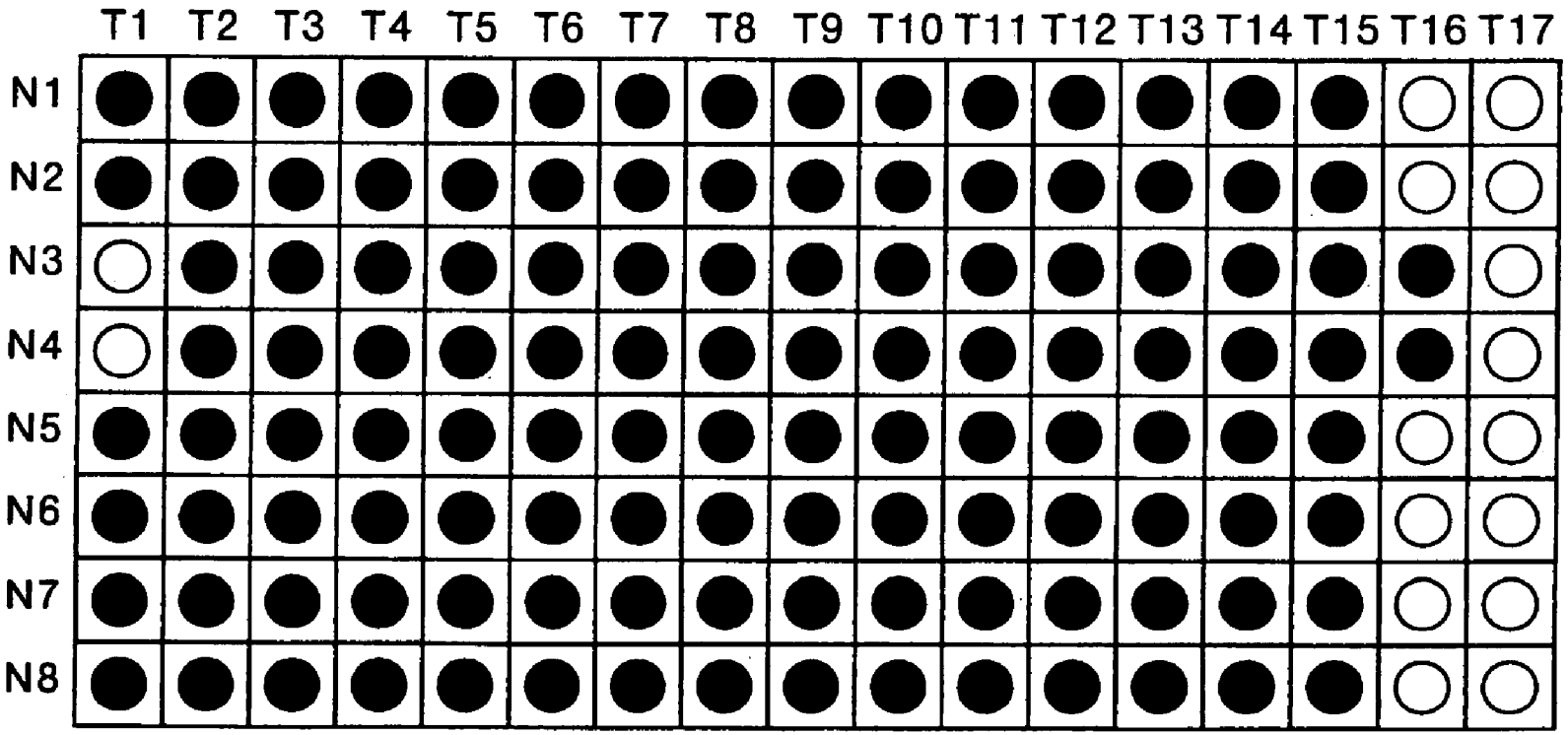
FIG. 5 shows a dot pattern.

The driving device 110 according to the first embodiment of the present invention will be described in more detail with reference to FIGS. 5 to 7. FIG. 5 shows a dot pattern when liquid drops are discharged from eight nozzle heads. In FIG. 5, black dots correspond to discharge data items for which liquid drops are to be discharged and white dots correspond to non-discharge data items for which liquid drops are not to be discharged. A data block in a column T1 includes eight data items in a first row N1 to an eighth row N8. After discharging of liquid drops corresponding to the column T1 is completed, liquid drops corresponding to a column T2 are discharged. By sequentially repeating this process, discharging of liquid drops is terminated at the final column T17. The dot pattern as shown in FIG. 5 corresponds to a case where the ratio occupied by discharge data (=1) is high, i.e., when liquid drops are applied to nearly the entire surface of a region. Typical examples of such application of liquid drops to the entire surface of a region includes coating a photoresist over the entire surface of an object substrate, performing hard coating on the surface of lens, and uniformly discharging liquid drops over an overcoat region of a liquid crystal substrate.

Figure 6:
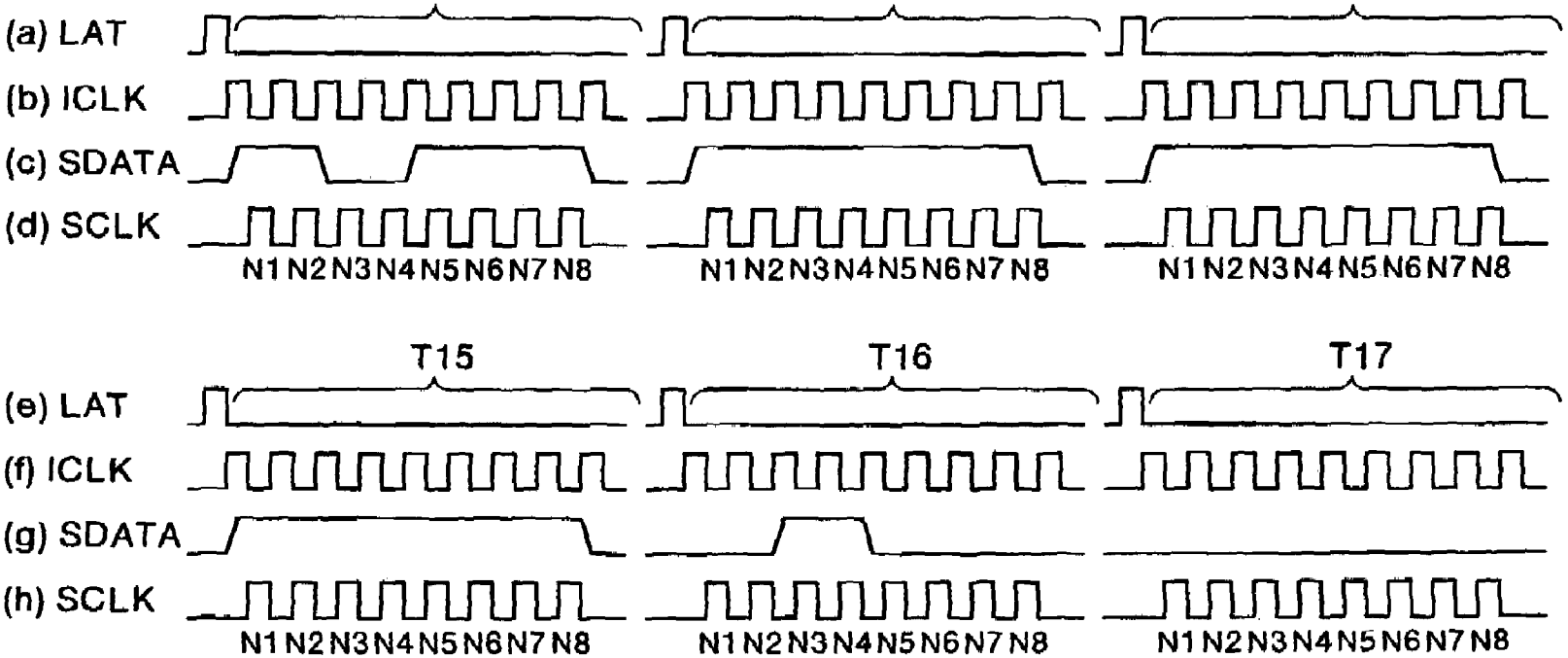
FIGS. 6(*a*)–6(*h*) are timing charts for data transmission according to prior art.

FIGS. 6(*a*) to 6(*h*) are timing charts for data transmission according to the prior art. FIGS. 6(*a*) to 6(*d*) are timing charts of three columns T1 to T3 at the start of printing and FIGS. 6(*e*) to 6(*h*) are timing charts of three columns T15 to T17 at the end of printing. For example, referring to the first column T1, the third row N3 and the fourth row N4 include non-discharge data represented by white dots and the other rows N1, N2, and N5 to N8 include discharge data represented by black dots. In the first column T1, non-discharge data (=0) as a data block SDATA in the third row N3 and the fourth row N4 and discharge data (=1) as a data block SDATA in the other rows N1, N2, and N5 to N8 are output to the head unit 150 from the driving device 110. At this time, the internal shift clock signal ILCK for the shift register 113 in the driving device 110 is also generated.

Further, referring to the second column T2, all the rows N1 to N8 include discharge data (=1) represented by black dots. In the conventional art, the internal shift clock signal ILCK for the shift register 113 in the driving device 110 is generated at all times in such a case. Furthermore, referring to the last column T17, all the rows N1 to N8 include non-discharge data (=0) represented by white dots. In the conventional art, the internal shift clock signal ILCK for the shift register 113 in the driving device 110 is generated even in such a case. In other words, in the conventional art, the internal shift clock signal ILCK is generated at all times, irrespectively of the contents of a data block input to the shift register 113 of the driving device 110. For this reason, the shift register 113 of the driving device 110 operates at all times. As a result, the power consumption and the amount of radiated heat increase. These problems become serious when the ratio occupied by discharge data (=1) as shown in FIG. 5 is high, i.e., when liquid drops are applied to nearly the entire surface of a region.

Figure 7:
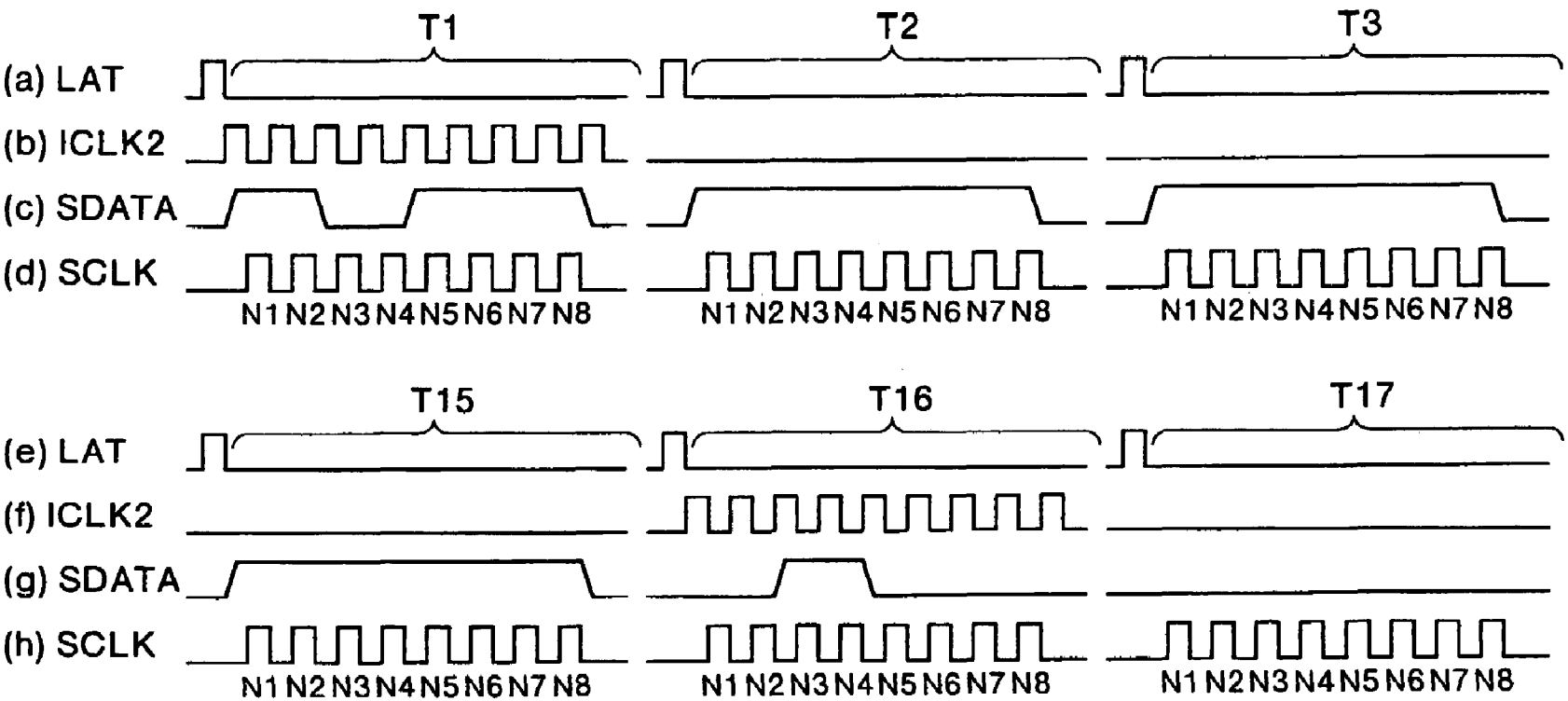
FIGS. 7(*a*)–7(*h*) are timing charts for data transmission according to the first embodiment of the present invention.

FIGS. 7(*a*) to 7(*h*) are timing charts for data transmission according to the first embodiment of the present invention. FIGS. 7(*a*) to 7(*d*) are timing charts of three columns T1 to T3 at the start of printing and FIGS. 7(*e*) to 7(*h*) are timing charts of three columns T15 to T17 at the end of printing. For example, the timing chart of the first column T1 is the same as the conventional timing chart of the first column T1 of FIG. 6(*a*). On the other hand, all of the rows N1 to N8 in the second column T2 include discharge data (=1) represented by black dots. In this embodiment, the generation of the internal shift clock signal ILCK2 for the shift register 113 in the driving device 110 is stopped. As a result, as can be seen from the timing chart of the column T2 of FIG. 7(*a*), the internal shift clock signal ILCK2 is not generated, and thus the shifter register 113 does not operate. At this time, the shift register 113 outputs all the pre-fixed data items, i.e., discharge data (=1), to the head unit 150.

In the third column T15 from the last column, as can be seen from FIG. 7(*f*), since all the rows N1 to N8 include discharge data (=1), the internal shift clock signal ILCK2 is not generated. On the other hand, in the column T16, the third row N3 and the fourth row N4 include discharge data (=1) represented by black dots and the other rows N1, N2, and N5 to N8 include non-discharge data (=0) represented by white dots. In this case, similarly to the conventional art, the internal shift clock signal ILCK2 is generated. Also, at the third row N3 and the fourth row N4, discharge data is output to the head unit 150. In the last column T17, all the rows N1 to N8 include non-discharge data (=0). Thus, the clock signal generation unit 114 stops generating the internal shift clock signal ILCK2. At this time, the shift register 113 outputs a predetermined data block, i.e., non-discharge data (=0), to the head unit 150.

As described above, in this embodiment, the data determination unit 112 determines whether all the data items of a data block are a discharge data block that discharge liquid drops or a non-discharge data block that do not discharge liquid drops. As apparent from the timing charts of FIGS. 7(*a*) to 7(*h*), the clock signal generation unit 114 stops generating the internal shift clock signal ILCK2 when all the data items of the data block are discharge data or non-discharge data. While the generation of the internal shift clock signal ILCK2 is stopped, the shift register 113 outputs pre-fixed data, i.e., a discharge data block or a non-discharge data block, to the head unit 150. For this reason, the generation of the internal shift clock signal ILCK2 is stopped corresponding to the contents of a data block input to the shift register 113 of the driving device 110. As a result, the power consumption caused by the shift register 113 of the driving device 110 and the amount of radiated heat are reduced. In particular, when the same pattern is transmitted repeatedly, a much more effect can be expected.

In this embodiment, the number of data determination units 112 is not limited to one. For example, a plurality of nozzles can be provided in every predetermined number of blocks and a plurality of data determination units 112 can be provided corresponding to the predetermined blocks. Thus, even when the number of nozzles is large, the driving of a shift register can be controlled for each block.

As a result, the power consumption caused by the driving of the shift register 113 and the amount of radiated heat can be certainly reduced. In summary, since data determination can be performed for each block, the number of patterns that can be determined increases. As a result, such data determination can be applied to any pattern other than discharge or non-discharge through all the nozzles. Thus, reductions in power consumption and the amount of radiated heat can be more effectively achieved.

Second Embodiment

Figure 8:
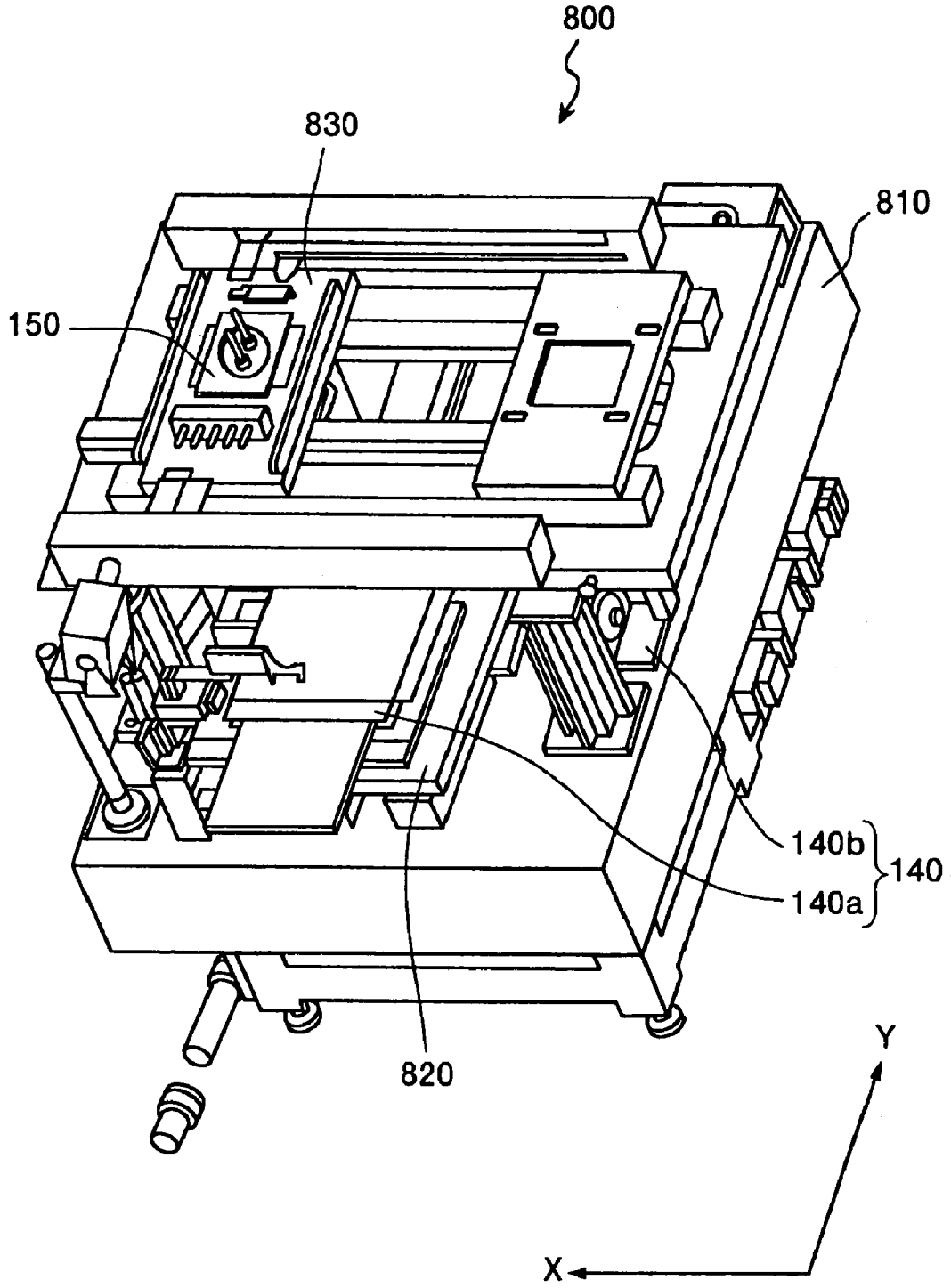
FIG. 8 is a perspective view of the structure of a liquid drop discharge apparatus according to a second embodiment of the present invention.
Figure 9:
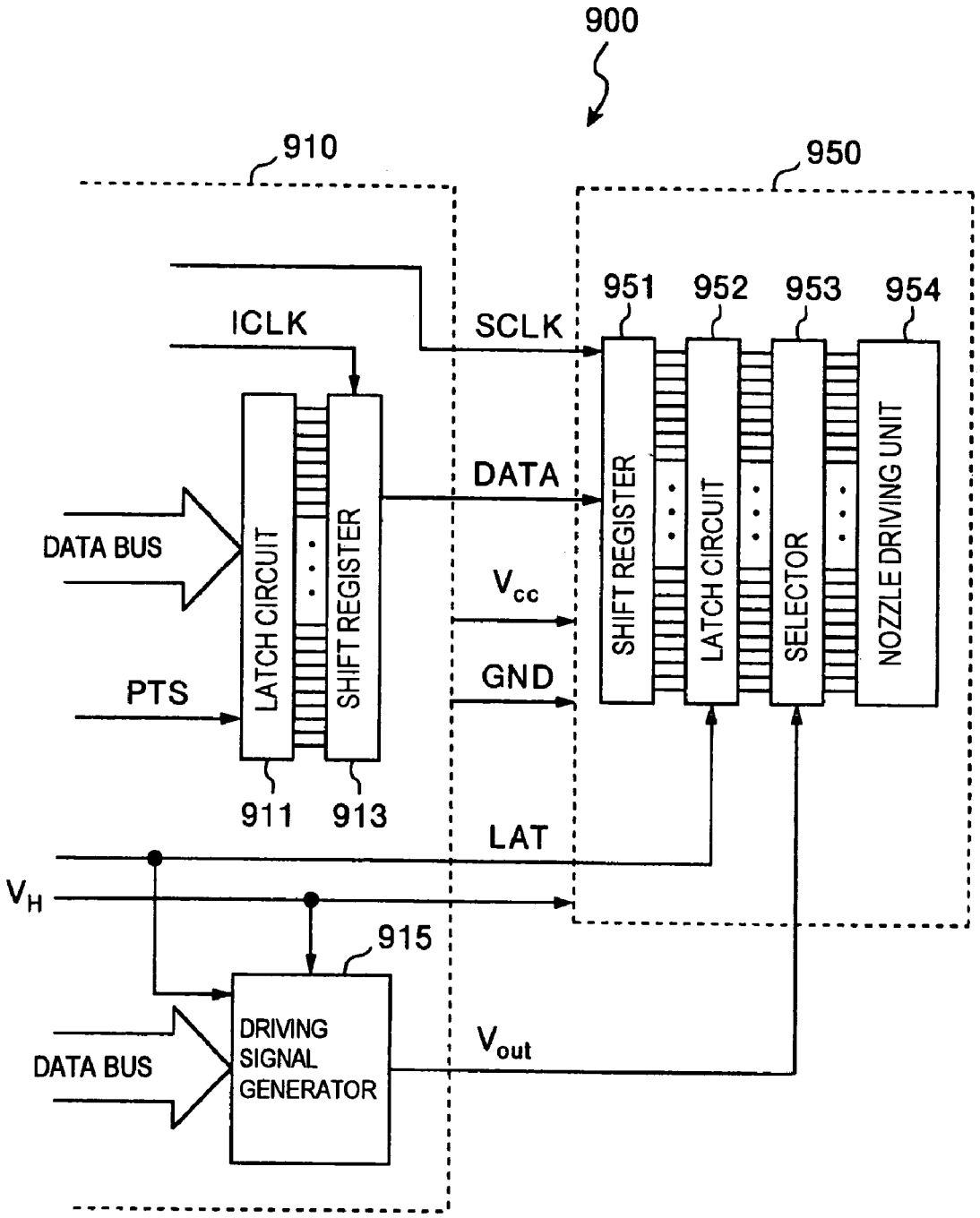
FIG. 9 schematically shows the structure of a conventional driving device and head unit.

FIG. 8 schematically shows the structure of a liquid drop discharge apparatus 800 according to a second embodiment of the present invention. The liquid drop discharge apparatus 800 uses ink as liquid drops. As shown in FIG. 8, the liquid drop discharge apparatus 800 includes a base member 810. A Y-axis table 820, which mounts thereon a color filter used in a liquid drop discharge object, for example, a display device, is provided on the base member 810. The Y-axis table 820 is disposed movably in the Y-axis direction of FIG. 8. In addition, an X-axis table 830 disposed movably in the x-axis direction of FIG. 8, is provided on the Y-axis table 820 of FIG. 8. A liquid drop discharge unit, i.e., the ink-jet head unit 150 according to the aforementioned first embodiment of the present invention is provided in the x-axis table 830. A driving device (not shown) connected to the head unit 150 through the FFC is also provided on the x-axis table 830. The ink-jet head unit 150 can be moved in the x-axis direction by the x-axis table 830. Ink is discharged through the ink nozzles of the ink-jet head unit 150 by an ink-jet method. More specifically, a voltage is provided to a piezoelectric element provided inside the head unit 150 and the ink is discharged through the ink nozzles by the vibration of the piezoelectric element. The liquid drop discharge apparatus 800 according to the second embodiment of the present invention can reduce the power consumption and the amount of radiated heat in the driving device. As a result, it is possible to attain a liquid drop discharge apparatus that reduces power consumption and the amount of radiated heat while using a conventional print head.

What is claimed is:

1. A driving device of an ink-jet print head that discharges liquid drops through a plurality of nozzles, comprising:

a data storage unit, which stores a data block having a plurality of data items for liquid drop discharge, each data item indicating one of discharge data for which liquid drops are to be discharged and non-discharge data for which liquid drops are not to be discharged;

a data determination unit, which determines the stored data block;

a driving device shift register, which outputs the determined data block to an ink-jet print head shift register; and a clock signal generation unit, which generates first clock signals for driving the driving device shift register and second clock signals for driving the ink-jet print head shift register;

wherein:

when the data items of the plurality are identical, the data determination unit generates a first signal indicating that the data items are identical and a second signal indicating one of that the data items indicate discharge data and that the data items indicate non-discharge data;

when the first signal is generated, the clock signal generation unit continues generating the second clock signals and stops generating the first clock signals for a number of cycles corresponding to a number of data items in the plurality; and when the first signal is generated, the data determination unit outputs the second signal to the ink-jet print head shift register.

2. The driving device of an ink-jet print head according to claim 1, wherein:

the plurality of nozzles are provided in every block having a predetermined number of the nozzles, and a plurality of data determination units are provided in the corresponding blocks.

3. A control method of a driving device of an ink-jet print head that discharges liquid drops through a plurality of nozzles, comprising:

a data storage step of storing a data block having a plurality of data items for liquid drop discharge, each data item indicating one of discharge data for which liquid drops are to be discharged and non-discharge data for which liquid drops are not to be discharged;

a data determination step of determining the stored data block;

a data output step of outputting the determined data block from a driving device shift register to an ink-jet print head shift register;

a first clock signal generation step of generating clock signals for driving the driving device shift register; and a second clock signal generation step of generating clock signals for driving the ink-jet print head shift register;

wherein:

when the data items of the plurality are identical, the data determination step further comprises generating a first signal that indicates that the data items are identical and generating a second signal that indicates one of that the data items indicate discharge data and that the data items indicate non-discharge data; and when the first signal is generated, the first clock signal generation step further comprises pausing the generating of the clock signals for driving the driving device shift register for a number of cycles corresponding to a number of data items in the plurality; and when the first signal is generated, the data output step further comprises outputting the second signal to the ink-jet print head shift register.

4. A liquid drop discharge apparatus comprising:

a driving device of an ink-jet print head according to claim 1, and a print head having a control unit that drives the plurality of nozzles based on the output from the driving device.

* * * * *